US007798255B2

(12) United States Patent
Gatell et al.

(10) Patent No.: US 7,798,255 B2
(45) Date of Patent: Sep. 21, 2010

(54) DRILL BITS HAVING OPTIMIZED CUTTING ELEMENT COUNTS FOR REDUCED TRACKING AND/OR INCREASED DRILLING PERFORMANCE

(75) Inventors: Joshua Gatell, Houston, TX (US); Amardeep Singh, Houston, TX (US); Scott D McDonough, The Woodlands, TX (US); Mohammed Boudrare, Bossier City, LA (US); Bryce A Baker, Houston, TX (US); Allen D White, Houston, TX (US); Brandon M Moss, Houston, TX (US); Parveen K Chandila, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 12/009,408

(22) Filed: Jan. 16, 2008

(65) Prior Publication Data

US 2008/0179102 A1 Jul. 31, 2008

Related U.S. Application Data

(60) Provisional application No. 60/880,820, filed on Jan. 16, 2007.

(51) Int. Cl.
*E21B 10/00* (2006.01)
*E21B 10/36* (2006.01)

(52) U.S. Cl. ..... 175/374; 175/426; 175/378

(58) Field of Classification Search ..... 175/374, 175/426, 378

See application file for complete search history.

(56) References Cited

U.S. PATENT DOCUMENTS

| | | | | |
|---|---|---|---|---|
| 4,056,153 | A * | 11/1977 | Miglierini | 175/376 |
| 5,372,210 | A | 12/1994 | Harrell | |
| 6,176,329 | B1 * | 1/2001 | Portwood et al. | 175/341 |
| 6,213,225 | B1 | 4/2001 | Chen | |
| 6,401,839 | B1 | 6/2002 | Chen | |
| 6,516,293 | B1 | 2/2003 | Huang et al. | |
| 6,527,068 | B1 | 3/2003 | Singh et al. | |
| 6,561,292 | B1 | 5/2003 | Portwood | |
| 6,827,161 | B2 | 12/2004 | Singh et al. | |
| 6,873,947 | B1 | 3/2005 | Huang et al. | |
| 6,942,045 | B2 | 9/2005 | Dennis | |
| 6,986,395 | B2 | 1/2006 | Chen | |
| 7,234,549 | B2 | 6/2007 | McDonough et al. | |
| 7,292,967 | B2 | 11/2007 | McDonough et al. | |
| 2004/0084222 | A1 * | 5/2004 | Klompenburg et al. | 175/331 |

OTHER PUBLICATIONS 8-3/4" F90D Product Brochure dated Aug. 1, 2005.

* cited by examiner

*Primary Examiner*—Jennifer H Gay
*Assistant Examiner*—Yong-Suk Ro

(57) ABSTRACT

A roller cone drill bit for drilling earth formation includes rows arranged on each of the cones such that, when viewed in routed profile, cutting element profiles partially overlap other cutting element profiles. The roller cone drill bit having at least a first three interior rows adjacent a gage row, each have a cutting element count selected from the group of 16, 18, 21 and 26 cutting elements.

30 Claims, 9 Drawing Sheets

| IADC BIT CLASSIFICATION SYSTEM<br>BIT FORMATION SERIES & TYPES | | |
|---|---|---|
| MILLED TOOTH BITS | | |
| Series | Formation | Types |
| 1 | Soft Formations/Low-Compressive Strength | 1 |
| | | 2 |
| | | 3 |
| 2 | Medium to Medium-Hard Formations/High Compressive Strength | 1 |
| | | 2 |
| | | 3 |
| 3 | Hard, Semi-Abrasive Formations | 1 |
| | | 2 |
| | | 3 |
| TCI BITS | | |
| Series | Formation | Type |
| 4 | Soft Formations/Low-Compressive Strength | 1 |
| | | 2 |
| | | 3 |
| | | 4 |
| 5 | Soft to Medium-Hard Formations/Low-Compressive Strength | 1 |
| | | 2 |
| | | 3 |
| | | 4 |
| 6 | Medium-Hard Formations/High-Compressive Strength | 1 |
| | | 2 |
| | | 3 |
| | | 4 |
| 7 | Hard, Semi-Abrasive and Abrasive Formations | 1 |
| | | 2 |
| | | 3 |
| | | 4 |
| 8 | Extremely Hard and Abrasive Formations | 1 |
| | | 2 |
| | | 3 |
| | | 4 |

FIG. 3

DRILL BITS HAVING OPTIMIZED CUTTING ELEMENT COUNTS FOR REDUCED TRACKING AND/OR INCREASED DRILLING PERFORMANCE

CROSS-REFERENCE TO RELATED APPLICATIONS

This application claims priority, pursuant to 35 U.S.C. §119(e), to U.S. Provisional Application No. 60/880,820 filed Jan. 16, 2007, which is incorporated herein by reference in its entirety.

STATEMENT REGARDING FEDERALLY SPONSORED RESEARCH OR DEVELOPMENT

Not applicable.

BACKGROUND OF INVENTION

1. Field of the Invention

The invention relates generally to roller cone drill bits for drilling earth formations, and more specifically to roller cone drill bits having optimized cutting element counts for reduced tracking and/or increased drilling performance.

2. Background Art

Roller cone rock bits are commonly used in the oil and gas industry for drilling wells. FIG. 1 shows one example of a roller cone drill bit used in a conventional drilling system for drilling a well bore in an earth formation. The drilling system includes a drilling rig 10 used to turn a drill string 12 which extends downward into a well bore 14. Connected to the end of the drill string 12 is roller cone drill bit 20.

A roller cone drill bit typically includes a bit body with a threaded connection at one end for connecting to a drill string and a plurality of roller cones, typically three, attached at the other end and able to rotate with respect to the bit body. Disposed on each of the cones is a plurality of cutting elements, typically arranged in rows, about the surface of the cones. The cutting elements may comprise tungsten carbide inserts, polycrystalline diamond compacts, or milled steel teeth.

Significant expense is involved in the design and manufacture of drill bits to produce drill bits with increased drilling efficiency and longevity. Roller cone bits are more complex in design than fixed cutter bits, in that the cutting surfaces of the bit are disposed on roller cones. Each of the roller cones independently rotates relative to the rotation of the bit body about an axis oblique to the axis of the bit body. Because the roller cones rotate independent of each other, the rotational speed of each cone is typically different. For a given cone, the cone rotation speed generally can be determined from the rotational speed of the bit and the effective radius of the "drive row" of the cone. The effective radius of a cone is generally related to the radial extent of the cutting elements on the cone that extend axially the farthest, with respect to the bit axis, toward the bottomhole. These cutting elements typically carry higher loads and may be considered as generally located on a so-called "drive row". The cutting elements located on the cone to drill the full diameter of the bit are referred above to as the "gage row".

Adding to the complexity of roller cone bit designs, cutting elements disposed on the cones of the roller cone bit deform the earth formation by a combination of compressive fracturing and shearing. Additionally, most modern roller cone bit designs have cutting elements arranged on each cone so that cutting elements on adjacent cones intermesh between the adjacent cones, as indicated for example at 29 in FIG. 2 and further described in U.S. Pat. No. 5,372,210 to Harrell. Intermeshing cutting elements on roller cone drill bits is typically desired to minimize bit balling between adjacent concentric rows of cutting elements on a cone and/or to permit higher insert protrusion to achieve competitive rates of penetration ("ROP") while preserving the longevity of the bit. However, intermeshing cutting elements on roller cone bits substantially constrains cutting element layout on the bit, thereby, further complicating me designing of roller cone drill bits.

Because of the complexity of roller cone bit designs, roller cone bits have been largely developed through a trial and error process that involves selecting an initial design, field testing the initial design, and then modifying the design to improve drilling performance. For example, when a bit design has been shown to result in cutting elements an one cone being worn down faster than cutting elements on another cone, a new bit design may be developed by simply adding more cutting elements to the cone that bad cutting elements that wore down faster in hopes of reducing wear on each of the cutting elements on that cone.

In more recent years, this trial and error process has been used in conjunction with other processes and programs proposed to predict characteristics associated with the drilling performance of the bit. For example, U.S. Pat. Nos. 6,213,225 and 6,986,395, issued to Chen, propose an optimization process for equalizing the downward (axial) force on each of the cones of a drill bit. U.S. Pat. Nos. 6,516,293 and 6,873,947, issued to Huang et al., disclose methods for designing roller cone drill bits which include simulating the drilling performance of a bit, adjusting a design parameter, and repeating the simulating and adjusting until an optimized performance is obtained.

The problem with current roller cone drill bit designs is that the resulting arrangements ore often arrived at somewhat arbitrarily. As a result, many prior art bits may provide less than optimal drilling performance due to problems which may not be readily detected, such as "tracking" and "slipping." Tracking occurs when cutting elements on a drill bit fall into previous impressions formed by other cutting elements at preceding moments in time during revolution of the drill bit. Slipping is related to tracking and occurs when cutting elements strike a portion of previous impressions made and then slide into the previous impressions rather than cutting into the uncut formation.

Cutting elements do not cut effectively when they fall or slide into previous impressions made by other cutting elements. In particular, tracking is inefficient because no fresh rock is cut. Slipping also should be avoided because it can result in uneven wear on cutting elements which can result in premature cutting element failure. Thus, tracking and slipping during drilling can lead to low penetration rates and in many cases uneven wear on the cutting elements and cone shell. By making proper adjustments to the arrangement of cutting elements on a bit, problems such as tracking and slipping can be significantly reduced. This is especially true for cutting elements on a drive row of a cone because the drive row generally governs the rotation speed of the cone.

Prior art exists for varying the orientation of asymmetric cutting elements on a bit to address tracking concerns. For example, U.S. Pat. No. 6,401,839, issued to Chen, discloses varying the orientation of the crests of chisel-type cutting elements within a row, or between overlapping rows of different cones, to reduce tracking problems and improve drilling performance. U.S. Pat. Nos. 6,527,068 and 6,827,161, issued to Singh, disclose methods for designing bits by simulating drilling with a bit to determine its drilling performance and then adjusting the orientation of at least one non-axisymmetric cutting element on the bit and repeating the simulating and determining until a performance parameter is determined to be at an optimum value. U.S. Pat. No. 6,942,045, issued to Dennis, discloses a method of using cutting elements with different geometries on a row of a bit to cut the same track of formation and help reduce tracking problems. However, in many drilling applications, such as the drilling of harder formations, the use of asymmetric cutting elements such as chisel-type cutting elements are not desired due to their poorer performance in these applications.

Prior art also exists for using different pitch patterns on a given row to address the tracking concerns. For example, U.S. patent application Ser. No. 10/853,869 (now U.S. Pat. No. 7,234,549) and Ser. No. 10/854,067 (now U.S. Pat. No. 7,292,967), titled "Methods for evaluating cutting arrangements for drill bits and their application to roller cone drill bit designs," which are assigned to the assignee of the present invention and incorporated herein by reference, disclose, inter alia, designing drill bits by varying the pitch pattern between cutting elements in a row to help reduce tracking problems and improve drilling performance.

While the above approaches are considered useful in particular applications, in other applications the use of asymmetric cutting elements is not desired and the use of different pitch patterns can be difficult to implement and can result in a more complex approach to drill bit design and manufacture than necessary for addressing tracking concerns. What is desired is a simplified design approach that results in reduced tracking for particular applications without sacrificing bit life or requiring increased time or cost associated with design and manufacturing.

SUMMARY OF INVENTION

In accordance with one aspect, the present invention provides a roller cone drill bit including a plurality of roller cones, each having a plurality of cutting elements mounted thereon. The cutting elements are arranged in rows on each of the cones. The rows include at least a gage row and a plurality of interior rows positioned radially interior from the gage row. The rows are arranged on the cones such that when viewed in rotated profile, cutting element profiles partially overlap with other cutting element profiles and the first three interior rows adjacent the gage row each have a cutting element count that is selected from the group of 16, 18, 21 and 26.

In accordance with another aspect, the present invention provides a roller cone drill bit having an IADC formation classification within the range of 54 to 84. The drill bit includes a plurality of roller cones, each having a plurality of cutting elements mounted thereon and arranged in rows. The rows on each cone include at least a gage row, and a first interior row that is radially interior from the gage row. The first interior row on each of the cones has a cutting element count selected from the group of 16, 18, 21 and 26.

In accordance with another aspect, the present invention provides a roller cone drill bit having three cones rotatably mounted to the bit body. Each of the cones has a plurality of cutting elements thereon and arranged in rows. The rows include at least a gage row and a first row interior from the gage row with respect to the bit axis. At least one cone on the bit has a cone speed ratio of around 1.4. The first interior row on each of the cones also has a cutting element count comprising one selected from the group of 16, 18, 21 and 26.

In accordance with another aspect, the present invention provides a roller cone drill bit having three cones rotatably mounted to the bit body. Each of the cones has a plurality of cutting elements thereon and arranged in rows. The rows include at least a gage row and a first row interior from the gage row with respect to the bit axis. At least one cone on the bit has a cone speed ratio of around 1.4. The first interior row on each of the cones also has a cutting element count comprising one selected from the group of 16, 18, 21 and 26.

Other aspects and advantages of the present invention will be apparent from the following description and the appended claims.

BRIEF DESCRIPTION OF DRAWINGS

FIG. 3 shows a partial view of an IADC bit classification chart.

DETAILED DESCRIPTION

The present invention provides roller cone drill bits having optimized cutting element counts for reduced tracking and/or improved drilling performance for given applications. Using programs, such as ones disclosed in U.S. Pat. Nos. 6,516,293 or 6,873,947 to Huang tn conjunction with other programs, such as the ones disclosed in U.S. Pat. Nos. 7,234,549 and 7,292,967 to McDonough, which are all assigned to the assignee of the present invention and incorporated herein by reference, it has been discovered that tracking issues can be satisfactorily addressed in selected applications by simply changing one or more cutting element counts on a row of a roller cone of a bit to a cutting element count that has been found to perform better at the given cone speed or in the given drilling application. By changing cutting element counts on rows instead of pitch patterns or insert geometries to address tracking and performance problems in these applications, simplicity in bit design and manufacture, as well as increased drilling life, can be achieved.

Thus, in accordance with one aspect, the present invention provides a roller cone drill bit having cutting element counts for rows selected dependent upon the cone speed expected during drilling. Tracking problems are generally cone speed dependent. Accordingly, cutting element counts that have been found to result in reduced tracking at the expected cone speeds are proposed for particular applications.

In accordance with another aspect of the present invention, cutting element counts are selected for rows on a roller cone drill bit dependent upon the given drilling application. Tracking problems for rows having particular cutting element counts have been also shown to be drilling application related. This is because particular cone speeds are more prevalent for particular drilling applications. Thus, in accordance with this aspect of the present invention, cutting element counts found to result in reduced tracking for bits designed for particular applications are also proposed.

In accordance with another aspect of the present invention, cutting element counts for rows on a roller cone drill bit may be selected dependent upon other aspects of the bit geometry which have been determined to influence or generally govern the relative rotation of the cones with respect to a rotation about the bit axis.

Figure 1:
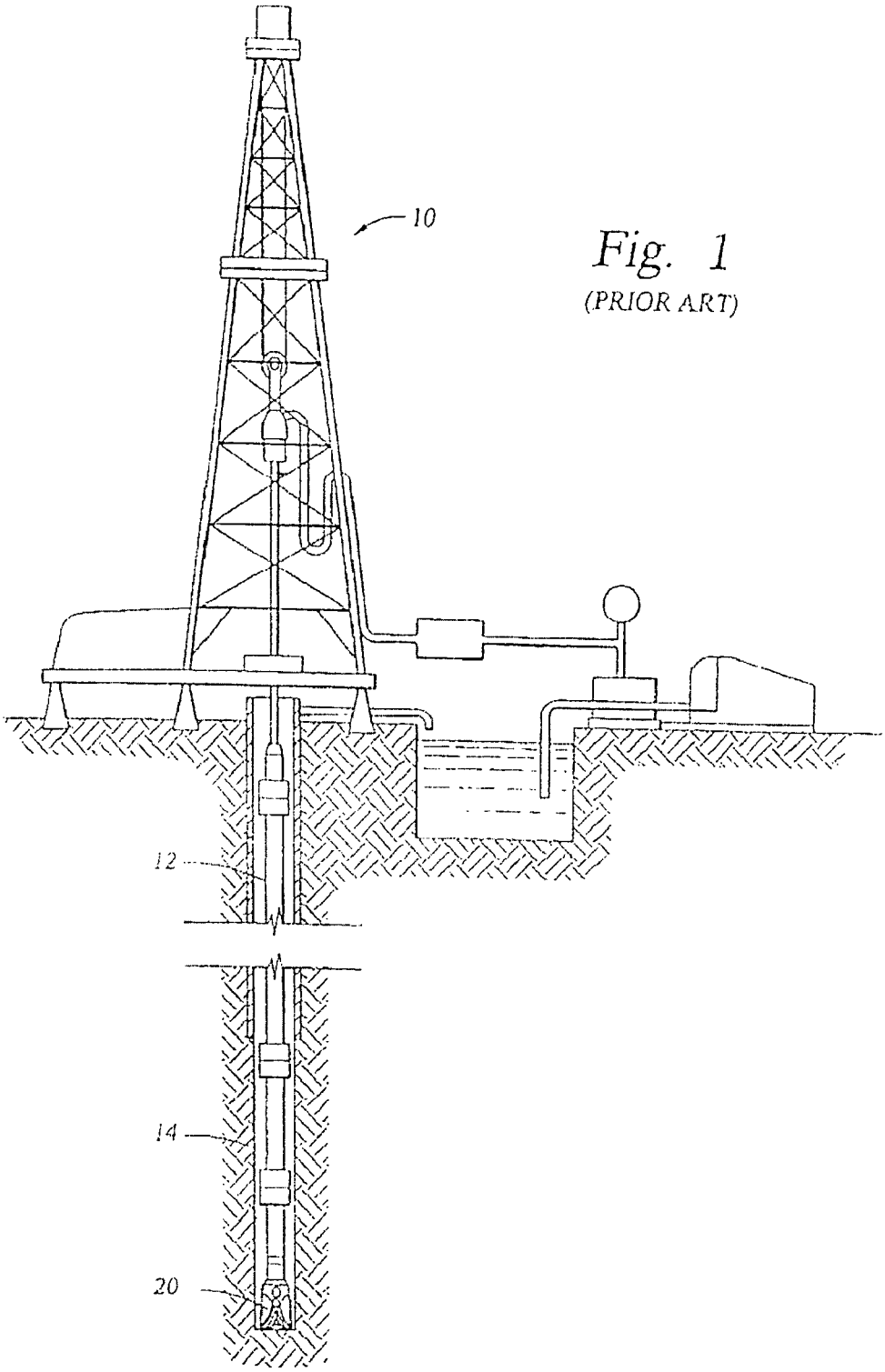
Fig. 1 (PRIOR ART)
FIG. 1 shows a prior art drilling system with a roller cone drill bit.
Figure 2:
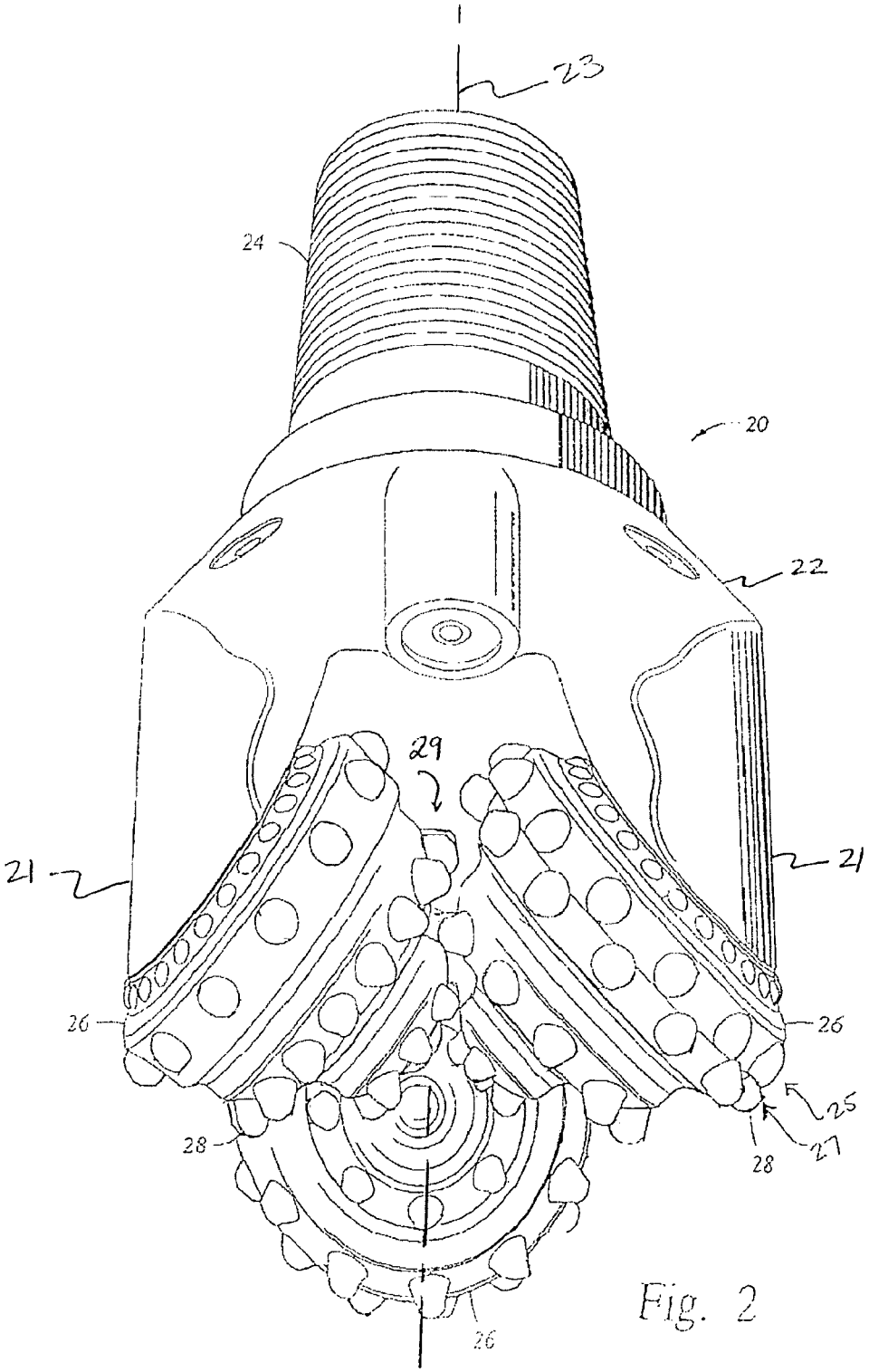
FIG. 2 snows aspects of a roller cone drill bit in accordance with one or more embodiments of the present invention.

Now, referring to FIG. 2, in accordance with one aspect of the present invention, a roller cone drill bit 20 includes a bit body 22 with a central axis 23. The bit body 22 has a threaded connection 24 at its upper end and a plurality of legs 21 extending downwardly at its lower end. A plurality of rolling cones (roller cone 26) are each rotatably mounted on a journal (not shown) which extends downwardly and inwardly from each leg 21. Each of the roller cones 26 includes a cutting structure comprising a plurality of cutting elements 28 arranged on the conical surface of the roller cones 26. The cutting elements 28 project from the roller cone body and act to break up earth formations at the bottom of a borehole when the bit 20 is rotated under an applied axial load during drilling. The cutting elements 28 may comprise teeth formed on the conical surface of the cone 26 (typically referred to as "milled teeth") or inserts press-fitted into holes formed in the conical surface of the cone 26 (such as tungsten carbide inserts or polycrystalline diamond compacts).

Further, in accordance with one aspect of the present invention, the bit is configured such that it has a resulting IADC classification within the range of 54 to 84. Those skilled in the art will appreciate that the International Association of Drilling Contractors (IADC) has established a bit classification system for the identification of bits suited for particular drilling applications. According to this system, each bit falls within a particular 3-digit IADC bit classification. The first digit in the IADC classification designates the formation "series" which indicates the type of cutting elements used on the roller cones of the bit as well as the hardness of the formation the bit is designed to drill. As shown for example in FIG. 3, a "series" in the range 1-3 designates a milled tooth bit, while a "series" in the range 4-8 designates a tungsten carbide insert (TCI) bit. The higher the series number used, the harder the formation the bit is designed to drill. As further shown in FIG. 3, a "series" designation of 4 designates TCI bits designed to drill soft formations with low compressive strength. Those skilled in the art will appreciate that such bits typically maximize the use of both conical and/or chisel inserts of large diameters and high projection combined with maximum cone offsets to achieve higher penetration rates and deep intermesh of cutting element rows to prevent bit balling in sticky formations. On the other hand, as shown in FIG. 3, a "series" designation of 8 designates TCI bits designed to drill extremely hard and abrasive formations. Those skilled in the art will appreciate that such bits typically including more wear-resistant inserts in the outer rows of the bit to prevent loss of bit gauge and maximum numbers of hemispherical-shaped inserts in the bottomhole cutting rows to provide cutter durability and increased bit life.

The second digit in the IADC bit classification designates the formation "type" within a given series which represent a further breakdown of the formation type to be drilled by the designated bit. As shown in FIG. 3, for each of series 4 to 8, the formation "types" are designated as 1 through 4. In this case, 1 represents the softest formation type for the series and type 4 represents the hardest formation type for the series. For example, a drill bit having the first two digits of the IADC classification as "63" would be used to drill harder formation than a drill bit with an IADC classification of "62". Additionally, as used herein, an IADC classification range indicated as "54-84" (or "54 to 84") should be understood to mean bits having an IADC classification within series 5 (type 4), series 6 (types 1 through 4), series 7 (types 1 through 4) or series 8 (types 1 through 4) or within any later adopted IADC classification that describes TCI bits that are intended for use in medium-hard formations of low compressive strength to extremely bard and abrasive formations.

The third digit of the IADC classification code relates to bearing design and gage protection and is, thus, omitted herein as extraneous.

Those skilled in the art will further appreciate that as formations to be drilled become progressively harder, the cutting elements used on the bits generally become relatively shorter with respect to their extension length from the surface of the roller cone. Cutting element extension lengths may be described in terms of a cutting element extension length to cutting element diameter ratio, as disclosed for example in U.S. Pat. No. 6,561,292. Bits in IADC series 5 to 8 typically have cutting element extension to diameter ratios which are less than 0.829. For bits with an IADC series of 6 or higher, this ratio is typically less than 0.75. For bits with an IADC series of 7 and 8, this ratio is typically less than 0.5.

Those skilled in the art also appreciate that roller cone drill bits designed to drill medium hard to extremely hard and abrasive formations typically include a "staggered" row of cutting elements arranged on at least one of the cones. For example, as shown for the bit in FIG. 2, one of the cones includes a gage row of cutting elements 25 with a first inner row of cutting elements 27 spaced a fractional pitch (circumferential distance between each cutting element on a row) from rotary (azimuthal) alignment with a position of a cutting element on the gage row 25. The cutting elements on the first interior row 27 are also laterally positioned with respect to the cone axis (not shown) such that a portion of their projected cross section overlaps with the projected cross section of the cutting elements of the adjacent gage row 25 when viewed in rotated profile (as shown for example in FIG. 4).

Figure 4:
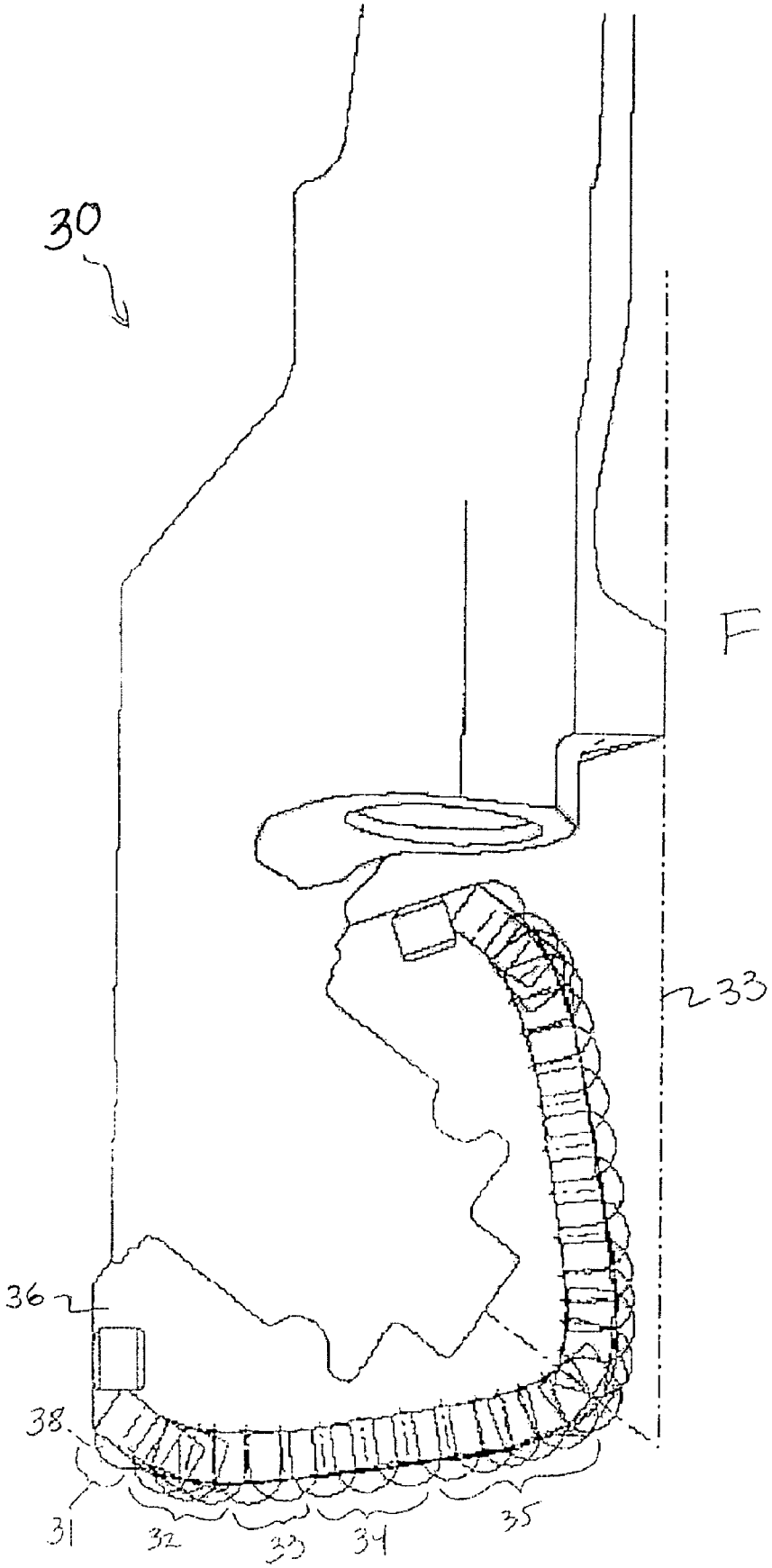
FIG. 4 shows a cross section profile view of a roller cone drill bit in accordance with one or more embodiments of the present invention.

FIG. 4 shows a partial section view taken through one leg of a roller cone drill bit 30 designed in accordance with aspects of the present invention. In this view all of the cones of the bit 36 are shown as a profile view rotated into a single plane with the profiles of the cutting elements 38 shown for each of the rows on the cones to generally illustrate the bottomhole coverage provided by cutting elements 38 mounted on bit 30. This view of the cutting structure will be referred herein to as the "rotated profile view."

In general, the inventors have discovered that cutting element counts of 5, 7, 10, 12, 15, 17, 19, 20, 22, and 25 when used for interior rows proximal a gage row on roller cone drill bits with IADC classifications within the range of 54 to 84 do not work as well in the given applications and tend to result in tracking problems. Thus, in accordance with an aspect of the present invention, a first interior row adjacent a gage row, or a drive row, on each roller cone of a roller cone drill bit having an IADC classification within the range of 54 to 84 preferably has a cutting element count (number of cutting elements on a row) selected from 13, 14, 16, 18, 21, or 26. Using these cutting element counts on first interior rows or drive rows of a roller cone bit have been found to result in improved drilling performance in the designated applications.

Referring to FIG. 4, in accordance with the above aspect of the present invention, the roller cone bit shown in FIG. 4 is configured such that, when viewed in rotated profile, the rows of cutting elements 38 on the cones 36 of the bit 30 partially overlap with profiles of other cutting element 38, and a selected number of interior rows adjacent the gage rows 31 as viewed in rotated profile each have cutting element counts (i.e., a number of cutting elements on a row) comprising one selected from the group of 13, 14, 16, 18, 21, and 26. For example, in one or more embodiments, the selected number of interior rows from gage having a cutting element count of 13, 14, 16, 18, 21, or 26 may comprise the first three interior rows (indicated as 32) adjacent the gage rows 31 when viewed in rotated profile. Thus, the first interior row adjacent gage will have 13, 14, 16, 18, 21, or 26 cutting elements in the row; the second interior row from gage will have 13, 14, 16, 18, 21, or 26cutting elements in the second row, and the third interior row from gage will have 13, 14, 16, 18, 21, or 26 cutting elements in the third row. For selected embodiments discussed herein, the list of preferred cutting element counts may be listed as counts of 13, 16, 18, 21, and 26; however, cutting element counts of 14 have been found to work well and; thus, are also included as preferred for embodiments of the present invention.

The general term "cutting elements" is used herein to refer to the primary cutting elements disposed on the bit which generally extend to cut the bottomhole. Using cutting element counts as noted above on each of the first three rows 32 adjacent the gage rows 31 of a bit having an IADC classification within the range of 54-84 has been found to result in improved drilling performance over conventional bits which have other cutting element counts in one or more of the first three rows adjacent gage.

Further, in one or more embodiments, the selected number of interior rows adjacent gage having a cutting element count of 13, 14, 16, 18, 21, or 26 may comprise a first five interior rows, 32 and 33 adjacent the gage rows 31. In such case each of the first five rows of cutting elements, 32 and 33, adjacent the gage rows 31 when viewed in rotated profile will have a cutting element count comprising one selected from the group of 13, 14, 16, 18, 21, or 26. For example, in one embodiment, a bit may be configured to have a first row adjacent gage comprising 18 cutting elements, second and third rows from gage comprising 16, 18, or 21 cutting elements, a fourth row from gage comprising 13, 14, or 16 cutting elements, and a fifth row from gage comprising 13, 14, 16, or 18 cutting elements. Again, for particular embodiments, this selection may be limited to cutting element counts of 13, 16, 18 and 21, but cutting element counts of 14 have been shown to work just as well and are thus useful for other embodiments of the present invention. Bits configured to have more than three rows adjacent gage with cutting element counts identified as preferred or optimal for interior rows on bits having IADC classifications within the rage of 54 to 84, and more particularly with IADC classifications within the range of 81 to 84, have been found to provide an additional improvement in drilling performance in particular application compared to other conventional bits used in these applications.

In addition to having a first five interior rows, 32 and 33, adjacent the gage rows 31, each comprising a cutting element count selected from the group of 13, 14, 16, 16, 21, and 26, in one or more embodiments, some or all of the remaining interior rows, 34 and 35, on the bit 30 may each comprise a cutting element count comprising one selected from the group of 1, 2, 3, 4, 6, 8, 11, 13, 14 and 16 cutting elements. In a particular embodiment all of the remaining interior rows may comprise cutting element counts selected from the group of 1, 2, 3, 4, 6, 8, 11, 13, 14, and 16 to avoid having interior rows with cutting element counts that have been found to not work as well in particular applications. While this may be done in one or more embodiments, it is generally believed that using cutting element counts identified as preferred or optimal for particular applications on at least the first three interior rows 32 adjacent gage rows 31 can provide a useful performance improvement over conventional bits used in these applications. This is because in many of these applications the rows disposed on the bit proximal to the gage rows 31 tend to extend axially farthest from the axis of rotation of the cones and, thus, tend to have a significant effect on the rotation speed of the cone.

As stated above, tracking problems for a row having a selected number of cutting elements are generally cone speed dependent. For example, it has been determined that average cone speeds for many bits designed for applications described above are typically around 1.4 times the rotation speed of the bit. It also has been discovered that cutting element counts of 1, 2, 3, 4, 6, 8, 11, 13, 14, 16, 18, 21, or 26 perform better for bits in applications that involve similar cone to bit speeds ratios (or cone to bit rotation ratios), such as cone to bit speeds ratios of between 1.350 and 1.475, and more particularly for those having cone to bit speed ratios of 1.4+/−0.025. These particular cutting element counts have been found to result in reduced tracking and improved drilling performance for bits having average cone speed ratios within these ranges. Therefore, in accordance with another aspect of the present invention, a roller cone drill bit may be provided having cutting element counts selected dependent on the cone speeds or cone to bit rotation ratios expected during drilling.

As noted in the Background herein, those skilled in the art will appreciate that the rotation speed of a cone generally can be approximated from the rotational speed of the bit and the effective radius of the "drive row". The effective radius of a drive row of a cone is generally related to the radial extent of the cutting elements that extend axially the farthest, with respect to the bit axis, toward the bottomhole. These cutting elements typically experience larger forces and are considered to form what is known as a so-called "drive row" on the cone. The drive row is the row or rows that generally govern the rotation speed of the cones.

Figure 7:
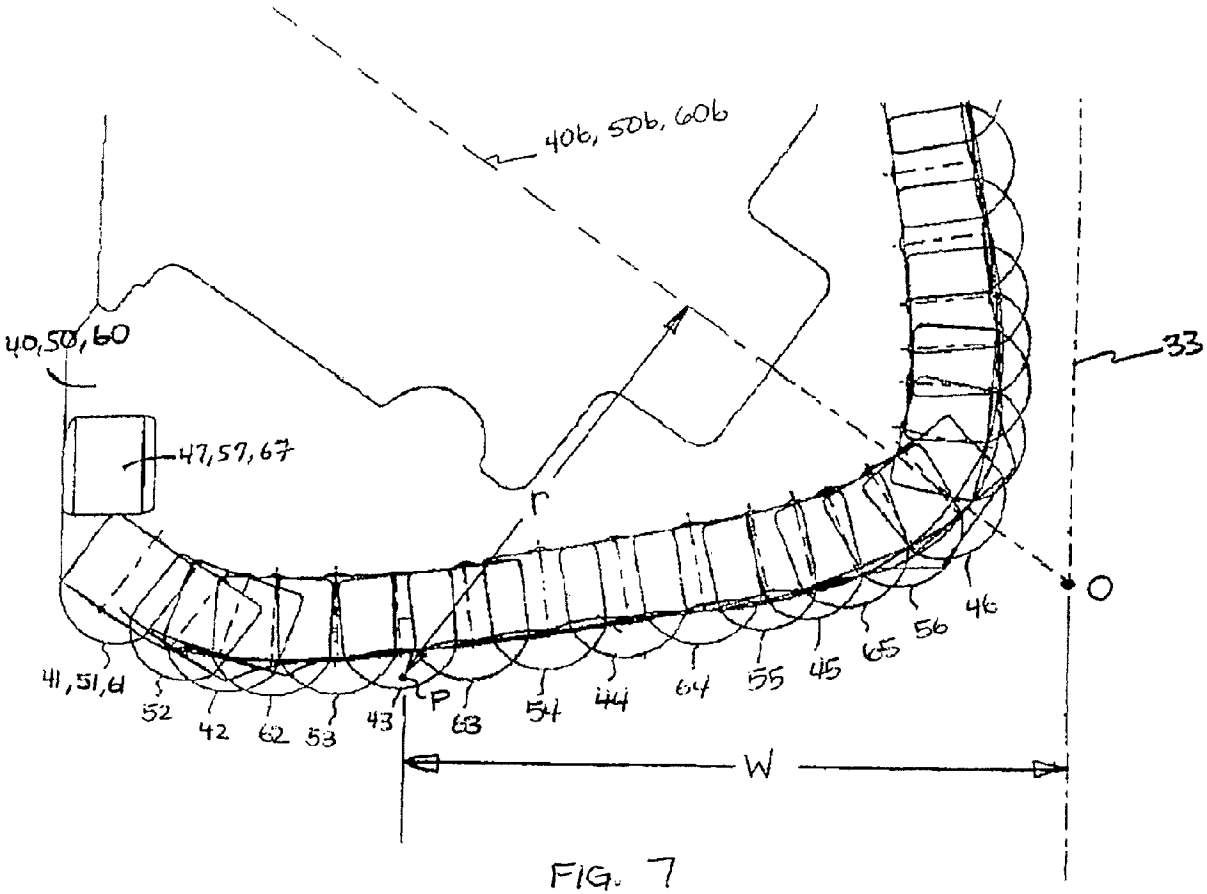
FIG. 7 shows a cross section profile view similar to that shown in FIG. 5 illustrating dimensions used to calculate a cone to bit speed ratio for roller cones of a drill bit.

One method for estimating the position of a drive row is illustrated, in FIG. 7. For example, the rotation ratio of each of the cones 40, 50, 60 can be determined, for example, using force calculations or by simulating the drilling of the bit as described in U.S. Pat. No. 6,516,293 filed on Mar. 13, 2000, and assigned to the assignee of the present invention. Given the rotation ratio of a cone, a radius ratio or the drive row distance W from the bit axis 33 with respect to effective cone radius r will be approximately related to the position of the drive row. Thus, the drive row position may be located approximately at the position along the cone axis 40*b*, 50*b*, or 60*b* where the ratio W/r is approximately the same as the rotation ratio of the cone. In any particular bit design, there may or may not be a row of cutting elements disposed at the calculated drive row location. In such case, the rows adjacent the location may be designated as the driving rows.

Referring to FIG. 4, in accordance with one aspect of the present invention, a roller cone bit is configured to have cones with an average speed ratio of around 1.4 and is further configured such that when viewed in rotated profile, the rows of cutting elements 38 on the cones 36 of the bit 30 partially overlap with profiles of other cutting element 38 and a selected number of interior rows adjacent the gage rows 31 each have a cutting element count selected from the group of 13, 16, 18, 21, and 26. In one or more embodiments, the selected number of interior rows adjacent gage having a cutting element count of 13, 16, 18, 21, or 26 may comprise the first interior row adjacent gage on each of the roller cones of the bit or the first three interior rows 32 adjacent gage when viewed in rotated profile. In selected embodiments, these preferred cutting element counts may be used on the first five interior rows (32 and 33 in FIG. 4) adjacent the gage rows 31. Additionally, in one or more of these embodiments, all of the remaining interior rows (34 and 35 in FIG. 4) on the bit 30 may each comprise a cutting element count of one selected from the group of 1, 2, 3, 4, 6, 8, 11, 13 and 16 cutting elements. Again, this may be done to avoid the placement of interior rows on the bit having cutting element counts that have been found to not work as well for particular applications; however, this is not required for embodiments of the present invention. Once again, it should be noted that in one or more embodiments in accordance with the above aspect, a cutting element count of 14 may also be used and has been found to be just as desirable as ones listed above.

Figure 5:
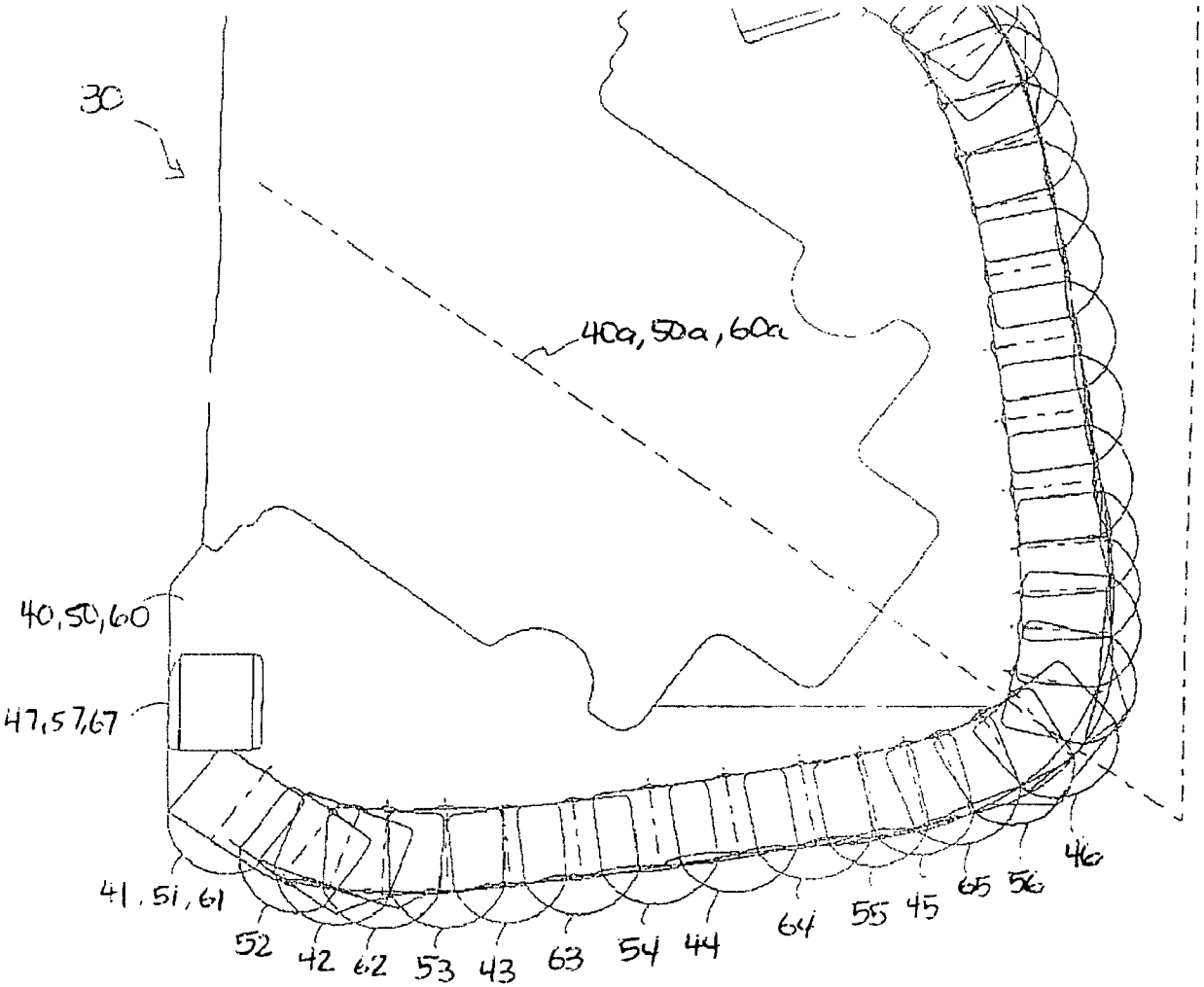
FIG. 5 shows an enlarged cross section profile view of the cutting structure of a roller cone drill bit designed in accordance with one or more aspects of the present invention.

FIG. 5 shows an enlarged rotated profile view of a bit in accordance with various aspects of the present invention. Three roller cones 40, 50, 60 of the bit are shown in rotated profile with the cutting element profiles shown for each of the rows 41-46, 51-56, and 61-65 on the cones 40, 50, 60 to generally illustrate the bottomhole coverage provided by Cutting elements on bit. A roller cone layout view of the drill bit in FIG. 5 is shown in FIG. 6, wherein a profile view of each of the roller cones 40 50, 60 generally arranged around a bit axis is shown with the cutting element profiles shown for each of the rows (41-46, 51-54, and 61-65) on the cones 40, 50, 60 to illustrate the intermeshing arrangement of the rows of cutting elements between adjacent the cones.

Figure 6:
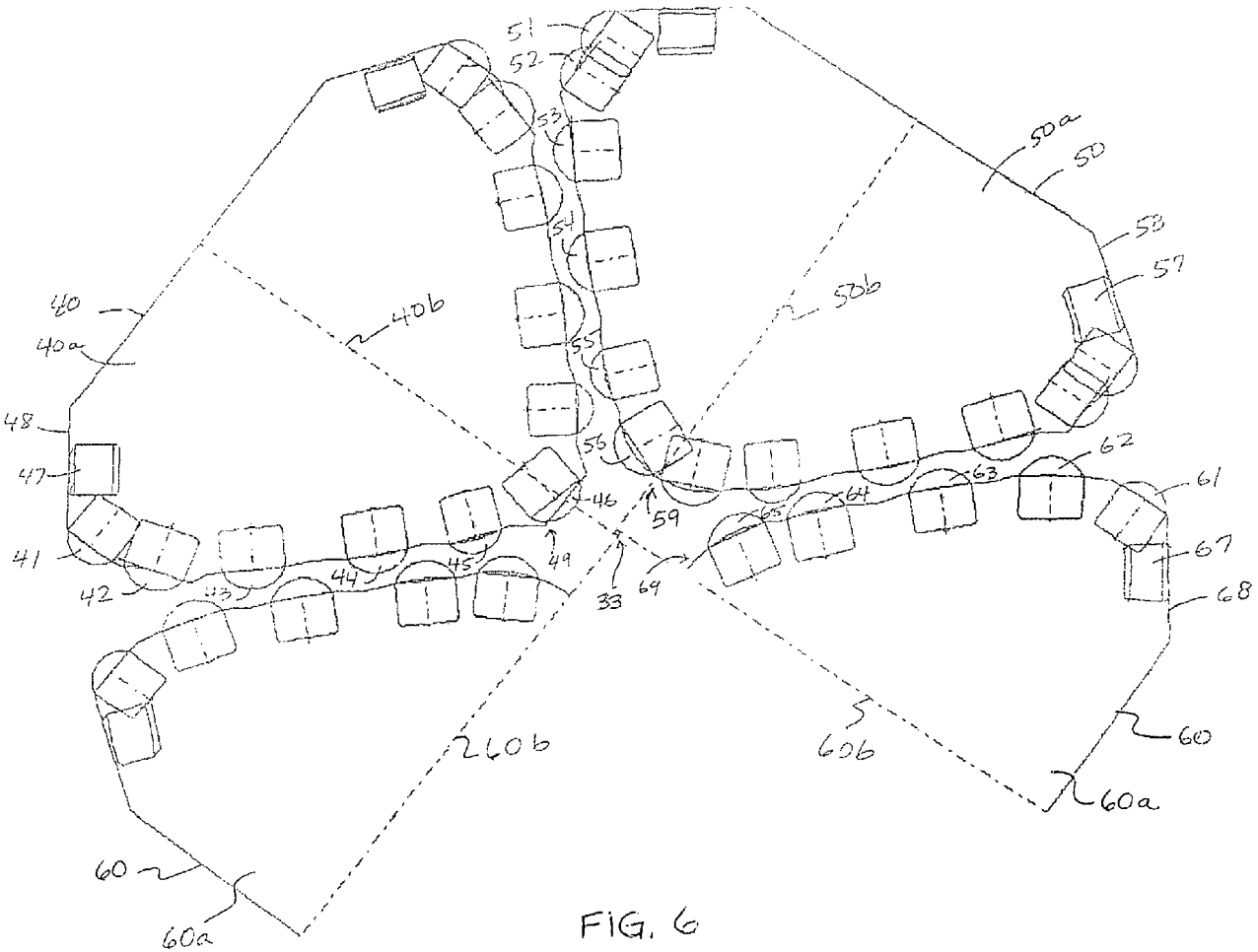
FIG. 6 shows a roller cone layout view of the roller cones of the bit shown in FIG. 5.

Referring to FIG. 6, each roller cone 40, 50, 60 has a cone body 40*a*, 50*a*, 60*a* made from steel or other material known in the art. Each cone body 40*a*, 50*a*, 60*a* has disposed about its surface a plurality of cutting elements generally arranged in concentric rows. The cutting elements in this example may be tungsten carbide inserts of any type known in the art. Each row of cutting elements is generally arranged such that all of the cutting elements in a given row are located at generally the same lateral distance from the cone axis 40*b*, 50*b*, 60*b* of the respective cone 40, 50, 60.

A first cone 40 includes a gage row of cutting elements 41 and a plurality of interior rows of cutting elements positioned radially interior (with respect to the central axis 33) from the gage row 41. The gage row of cutting elements 41 are generally positioned to cut to the gage diameter of the bit. The interior rows of cutting elements are positioned radially inward from the gage diameter and function to cut the bottom of the bore hole. The plurality of interior rows of cutting elements include a first interior row of cutting elements 42 positioned adjacent the gage row 41, a second interior row of cutting elements 43, a third interior row of cutting elements 44, and a fourth interior row of cutting elements 45. The cone 40 further includes a centrally located cutting element 46 disposed on a nose portion 49 of the cone 40. The first cone 40 also includes a "heel row" of cutting elements 47 disposed on a heel surface 48 of the cone. The heel row cutting elements 47 are positioned to help maintain the gage diameter of the wellbore drilled. The first cone 40 may also include "ridge row" cutting elements (not shown) which may be positioned to extend between adjacent rows of cutting elements on the cone to break up ridges of formation that may form and protrude between rows of cutting elements during drilling. Those skilled in the art will appreciate that "ridge row" cutting elements are cutting elements that do not extend to the bottomhole but, rather, have significantly shorter extension lengths from the cone surface and may be included on the cone to minimize formation contact with the softer cone body. Ridge row cutting elements are typically arranged dependent upon the other cutting elements arranged on the bit.

The second cone 50 also includes a gage row of cutting elements 51 and a plurality of interior rows of cutting elements, positioned radially interior from the gage row 51. The interior rows of cutting elements include a first interior row of cutting elements 52 positioned adjacent the gage row 51, a second interior row of cutting elements 53, a third interior row of cutting elements 54, and a fourth interior row of cutting elements 55. The second cone 50 also includes a centrally located row of cutting elements 56 which is disposed about the nose portion 59 of the cone. The second cone 50 further includes a "heel row" of cutting elements 57 disposed on a heel surface 58 of the cone and may include one or more "ridge rows" of cutting elements (not shown) positioned between adjacent rows of cutting elements on the cone to break up ridges of formation that may protrude between rows during drilling.

The third cone 60 also includes a gage row of cutting elements 61 and a plurality of interior rows of cutting elements positioned radially interior from the gage row 61. The plurality of interior rows on the third cone 60 include a first interior row of cutting elements 62 positioned adjacent the gage row 61, a second interior row of cutting elements 63, a third interior row of cutting elements 64, and a fourth interior row of cutting elements 65 proximal a nose portion 69 of the cone body 60. The third cone 60 further includes a "heel row" of cutting elements 67 disposed on a heel surface 68 of the third cone and may additionally include one of more "ridge rows" of cutting elements (not shown) disposed between selected rows of cutting elements to help break up ridges of formation that may protrude between rows during drilling.

In accordance with aspects of the present invention, a plurality of selected interior rows on the roller cones may each have a cutting element count comprising one selected from the group of 1, 2, 4, 6, 8, 11, 13, 14, 16, 18, 21, and 26. In one or more embodiments, the selected interior rows may comprise three or more interior rows positioned proximal the gage rows when viewed in rotated profile. In one or more embodiments, the selected interior rows may comprise at least a drive row on each of the cones. Additionally, in one or more embodiments, the selected interior rows on the bit may comprise all or substantially all of the interior rows positioned on the bit to cut the bottomhole.

Referring to the specific example as shown in FIG. 6, in this embodiment each of the first interior rows 42, 52, 62 adjacent a gage row 41, 51, 61 on each of the cones 40, 50, 60 has a cutting element count comprising one selected from the group of 13, 16, 18, 21, and 26. When viewed in rotated profile, as shown in FIG. 5, this equates to the first three interior rows 42, 52, 62 positioned adjacent the gage rows 41, 51, 61 having cutting element counts of 13, 16, 18, 21, and 26.

A bit designed in accordance with FIG. 6, may further include at least two of the second interior rows 43, 53, 63 from a gage row 41, 51, 61 on each of the cones 40, 50, 60 having a cutting element count comprising one selected from the group of 13, 16, 18, 21, and 26. When viewed in rotated profile, as shown in FIG. 5, this may equate to the first five interior rows 42, 52, positioned adjacent the gage rows 41, 51, 61 having cutting element counts of 13, 16, 18, 21, and 26. In another embodiment, all of the second interior rows 43, 53, 63 may have a cutting element count comprising one selected from the group of 13, 16, 18, 21, and 26; however this may not be feasible in some bit designs due to other design restraints. Additionally, in alternative embodiments, a cutting element count of 14 may also be used for one or more of the rows.

Referring to FIG. 5, in one or more embodiments, the remaining interior rows of cutting elements on the bit (44-46, 54-56, 63-65) may each have a cutting element count selected from the group of 1, 2, 3, 4, 6, 8, 11, 13, and 16. For example, in one or more embodiments, the six, seventh, and eighth interior rows of cutting elements, 63, 54, and 44, respectively, from gage may each have a cutting element count comprising one selected from the group of 6, 8, 11, 13, 16, and 18. The ninth, tenth, eleventh, twelfth and thirteenth interior rows of cutting elements 64, 55, 45, 65, and 56, from gage may each have a cutting element count selected from the group of 1, 2, 3, 6, and 8 cutting elements. The centrally located cutting element 46 also may generally be referred to as a row with a cutting element count of one.

Referring to FIG. 6, two of the cones in the example shown have a first row of cutting elements adjacent a gage row which is generally staggered with respect a gage row. For example, the first cone 40 has a first interior row of cutting elements 42 which are laterally positioned with respect to the cone axis 40*b* such that a portion of their projected cross section overlaps with the projected cross section of the cutting elements of the adjacent gage row 41 when viewed in rotated profile. The overlap in this case occurs at the bottom portions of the cutting elements. Because of this overlap, the azimuthal (rotary) position of the first interior row of cutting elements 42 is spaced at least a fractional pitch (circumferential distance between each cutting element on a row) from rotary (azimuthal) alignment with a position of a cutting element on the gage row 41.

Similarly, the second cone 50 in FIG. 6 also includes a first interior row of cutting elements 52 which are laterally positioned with respect to the axis 50*b* such that a portion of their projected cross section overlaps the projected cross section of the cutting elements in the gage row 51. The overlap occurs along the grip portions of the cutting elements. Because of this overlap, the azimuthal (rotary) position of the first interior row of cutting elements 52 is spaced at least a fractional pitch from rotary (azimuthal) alignment with the position of the cutting elements on the gage row 51.

The third cone 60 in this case does not include a staggered row with respect to the gage row 61. Thus, the position about the circumference of each cutting element in the first interior row 62 may be generally positioned independent of the azimuthal (rotary) position of a cutting element in the gage row 61.

The particular bit design shown in FIGS. 5 and 6 is configured to have an IADC classification within the range of 81 to 84. In this case the cutting elements are generally conical in form and have cutting element extensions to diameter ratios which are less than 0.829.

The bit shown in FIGS. 5 and 6 is also designed to have an average cone to bit speed ratio for each of the cones within a range of 1.4+/−0.025 (i.e., between 1.375 and 1.425). As shown in FIG. 7, a cone to bit speed ratio for a given row generally can be described as a ratio of the radius W from the bit axis to the reference point corresponding to an effective radius of the row and the radius from the cone axis to the reference point corresponding to the effective radius, r, of the row. In the example shown, the reference point, P, corresponding to the effective radius, r, is taken as a point along the cutting element axis corresponding to an expected penetration of the cutting element into the earth formation. In this case, the reference point, P, is defined at ⅓ of the extension height from the insert tip. Also in this case, the cones of the bit each have average cone speed ratio of around 1.4 and the rows functioning as the drive rows on each of the cones generally have a calculated effective bit to cone radius ratio (W/r) within the range of 1.375 to 1.425.

Figure 9:
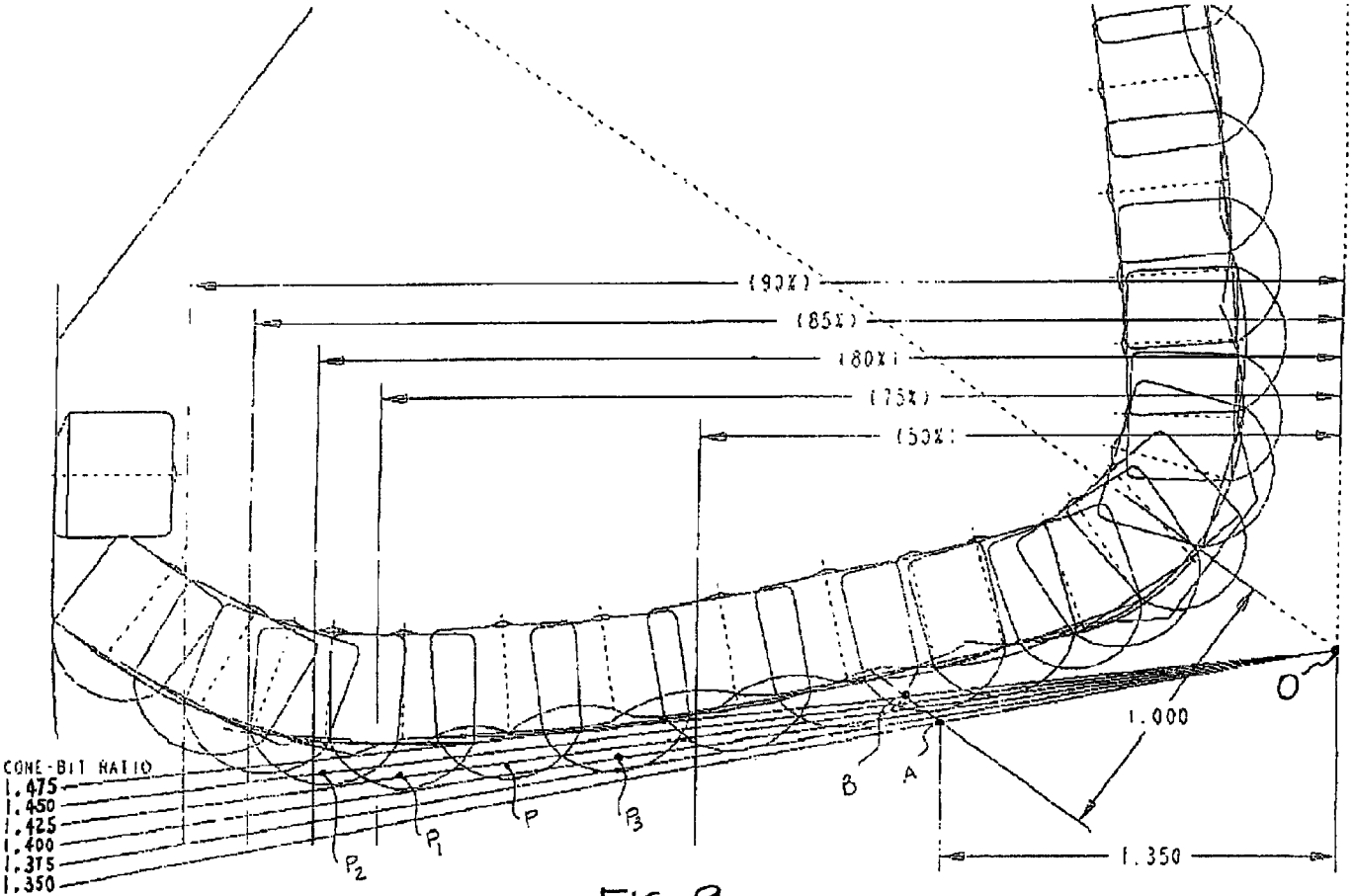
FIG. 9 shows a rotated profile view of a roller cone having at least one cutting element on each of the cones with a reference point P lying within a defined geometric envelope in accordance with another aspect of the present invention.

In accordance with another aspect of the present invention, instead of describing a bit in terms of a calculated rotation ratio or an assigned IADC classification, a bit in accordance with an embodiment of the present invention may be defined in terms of selected geometric parameters related to the cutting structure layout of the bit. For example, in one or more embodiments, a bit in accordance with the present invention may comprise a bit having a plurality of cones with cutting elements mounted on the cones wherein at least one of the cutting elements on each of the cones has a reference point P at ⅓ of its extension height from the insert tip along the insert axis which lies within a geometric envelope defined between 50% and 90% of the distance from the bit centerline to the gage diameter of the bit and between boundaries corresponding to cone to bit rotation ratios (or bit to cone radius ratios) of 1.350 and 1.475 as shown in FIG. 9. The boundary corresponding to a bit rotation ratio of 1.350 is a line drawn from the point O (where the cone axis intersects the bit axis in rotated profile) which corresponds to a bit to cone radius ratio (W/r) equal to 1.350. For simplicity, this line can be geometrically defined as a line originating from point O and passing through a second point A located 1.350 inches away from the bit axis and 1.000 inches away from the cone axis, as shown in FIG. 9. The boundary corresponding to a bit rotation ratio of 1.475 is a line drawn from the point O which corresponds to a bit to cone radius ratio (W/r) equal to 1.475. For simplicity, this line can be geometrically defined as a line originating from point O and passing through a second point B located 1.475 inches away from the bit axis and 1.000 inches away from the cone axis, as shown in FIG. 9. Thus, in accordance with this aspect of the present invention, bits having at least one cutting element on each of the cones with an effective radius reference point P between 50% to 90% of the distance from the bit centerline to the gage diameter and between lines drawn through point O having slopes of 1.350 and 1.475, respectively, will generally be considered to be a bit in accordance with an embodiment of the present invention if it has cutting element counts for rows as described above.

In accordance with the above aspect of the invention, in one or more embodiments, the at least one cutting element on each of the cones will have a reference point P at ⅓ of its extension height which lies within the geometric envelope defined between 50% and 85% of the distance from the bit centerline to the gage diameter of the bit and between boundaries corresponding to cone to bit rotation ratios (or bit to cone radius ratios) of 1.350 and 1.475, and more preferably between boundaries corresponding to cone to bit rotation ratios of 1.375 and 1.450. For the embodiment shown in FIG. 9, each of the cones has at least one cutting element with a reference point P (in this case, reference points P, $P_1$, $P_2$, $P_3$) at ⅓ of their extension height which lie on or in the geometric envelope defined between 50% and 80% of the distance from the bit centerline to the gage diameter of the bit and between boundaries corresponding to cone to bit rotation ratios of 1.400 and 1.450. The geometric envelope defined for embodiments noted above is an envelope which generally covers an area corresponding to an expected drive row for a bit that would have a resulting cone to bit speed ratio that is generally around 1.4. Preferred cutting element counts in accordance with other aspects of the invention as discussed above are considered particularly useful on bits that fall within these geometric parameters, and especially for bits that fall within the narrower geometric envelope of between 50% and 80% of the distance from the bit centerline to the gage diameter of the bit and between boundaries corresponding to cone to bit rotation ratios (or bit to cone radius ratios) of 1.400 and 1.450.

Figure 8:
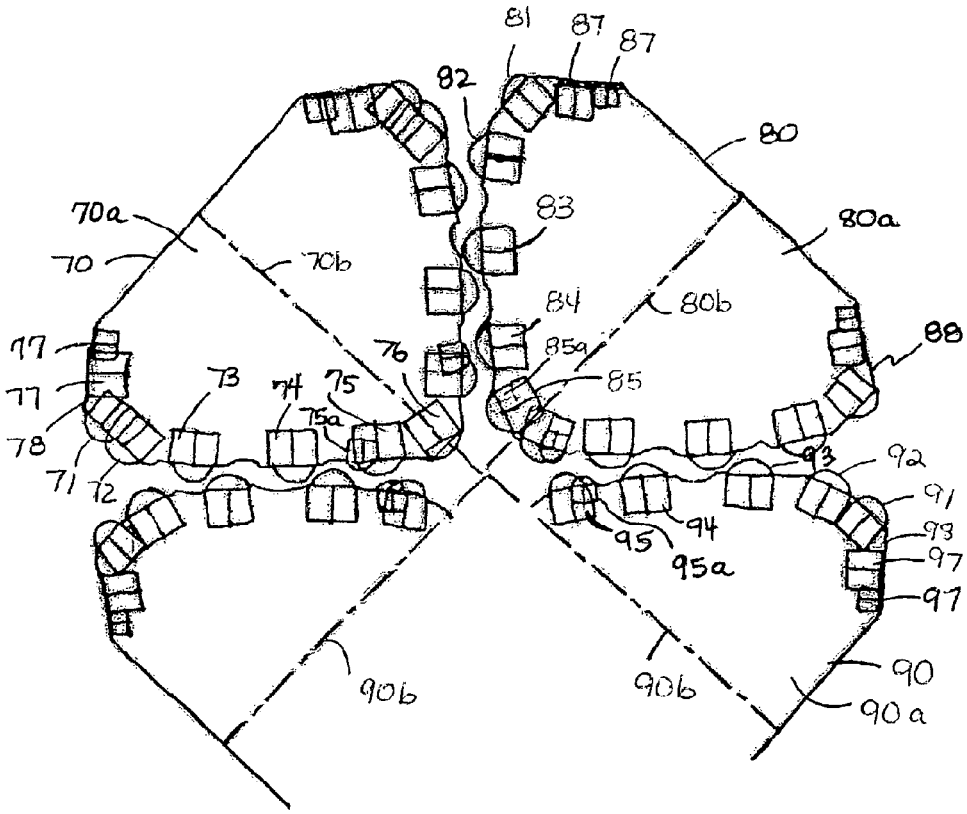
FIG. 8 shows a roller cone layout view of another embodiment in accordance with aspects of the present invention.

Another embodiment of a bit designed in accordance with aspects of the present invention is shown in FIG. 8. This embodiment shows a bit having an IADC code of 817 or higher (such as 837Y). A bit designed in accordance with this embodiment was found to perform better when each of the cones 70, 80, 90 included first inner rows 72, 82, 92 adjacent the gage rows 71, 81, 91 with cutting element counts comprising one selected from the group of 13, 16, 18, or 21 cutting elements. Cutting element counts of 5, 7, 10, 12, 15, 17, 19, 20, 22, and 25 for rows on cones of the bit did not work as well and resulted in tracking problems which were not fully apparent upon inspection of the dull bit but became apparent in simulations of the drilling performance by the bit in the selected application. Performance of the bit in the selected application was found to be further improved by using cutting element counts of 13, 16, 18, or 21 on each of the first five rows of the bit (72, 92, 82, 73, and 93 respectively) positioned closest to gage when viewed in rotated profile. A bit having an IADC code of 837Y was then manufactured in accordance with this embodiment with the first five rows closest to gage (not contacting gage) having cutting element counts of 16, 21, 21, 18, 16, respectively. The bit was then run in an East Texas application and was found to result in a 72% increase in footage drilled and a 13.8% increase in ROP over conventional bits previously used in the application.

The bit in this case included a total of 13 interior rows as shown (72-76, 82-85, 92-95), wherein the remaining interior rows on the bit were selected to have cutting element counts of 1, 2, 3, 4, 6, 8, 11, or 13. More specifically the first cone 70 included interior rows 72-76 as shown which had cutting element counts selected as 16, 18, 11, 4 and 1, respectively; the second cone 80 included interior rows 82-85 as shown which had cutting element counts of 21, 13, 6, and 1, respectively; the third cone 90 included interior rows 92-95 as shown which had cutting element counts selected as 21, 16, 8, and 3, respectively. Several similar bits have since been run in Travis Peak & Cotton Valley formation applications and have been found to provide advantageously improved performance over the prior art bits previously used. As noted above, in addition to the preferred cutting element counts noted above, a cutting element count of 14 may also be used to achieve similar results and, thus, is considered a preferred count in accordance with aspects of the present invention.

The bit also included "ridge row" cutting elements between interior rows as shown. More specifically, the first cone 70 included a ridge row of cutting elements 75*a* which comprised 4 ridge cutting elements 75*a* staggered with the cutting elements of the fourth interior row 75 on the first cone 70. The second cone 80 also included a ridge row of cutting elements 85*a* which comprised 2 ridge cutting elements 85*a* staggered with the cutting elements of the fourth interior row 85 of the second cone 80. The third cone 90 also included a row of ridge row cutting elements 95*a* which comprised 3 ridge cutting elements 95*a* staggered with the cutting elements of the fourth interior row 95 on the third cone 90.

The bit further included heel row cutting elements 77, 87, 97 on each of the cones positioned on the heel surfaces 78, 88, 98 of the cones help maintain the full gage diameter of the bit cut by the gage cutting elements 71, 81, 91 on the cones 70, 80, 90. In this case the gage cutting elements as well as the heel row cutting elements each had a cutting element count of one selected from the group of 16, 18, 21, and 26. However, it should be appreciated that other cutting element counts may be used for these rows in other embodiments without departing from the scope of the present invention.

Embodiments in accordance with the present invention have been found to result in improved drilling rates and reduced risk of damage to the bit cutting structure during drilling in selected applications. In particular, field tests have shown that bits designed having cutting element counts as described above may be used to drill faster and/or longer in the applications noted above than prior art counterparts. Further, it has been shown that embodiments in accordance with aspects of the present invention may provide improve ROP and/or improved bit life in harder formation applications where tracking can be an issue that may not be readily apparent form the dull conditions of the bits. Designing bits having optimizing cutting element counts as described above on selected rows of the roller cone drill bits may result in drill bits that drill faster and further, which can result in reduced drilling time and costs compared to conventional bits used. Additionally, it should be understood that the various aspects of the invention can be implemented on other drill bits, such as those in which the cutting elements are formed integrally with the body of the roller cone.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A roller cone drill bit comprising:

a bit body having a central axis and a plurality of legs depending therefrom, each leg having a journal, a roller cone rotatably mounted on each journal, each roller cone having a plurality of cutting elements thereon, the cutting elements arranged in rows on each of the cones, the rows including at least a gage row and a plurality of interior rows positioned radially interior from the gage row, the rows being arranged on each of the cones such that cutting element profiles when viewed in rotated profile partially overlap with other cutting element profiles, and a first three of the interior rows adjacent a gage row in rotated profile each have a cutting element count selected from the group of 16, 18, and 21.

2. The bit according to claim 1, wherein a first interior row from gage has a cutting element count selected from the group of 16, 18, and 21; a second interior row from gage has a cutting element count of 21; and a third first interior row from gage has a cutting element count of 21.

3. The bit according to claim 1, further comprising a fourth interior row and a fifth interior row from gage when viewed in rotated profile, wherein the fourth and fifth interior rows from gage each have a cutting element count selected from the group of 13, 16, 18, and 21.

4. The bit according to claim 3, wherein remaining interior rows of cutting elements each have a cutting element count selected from the group of 1, 2, 3, 4, 6, 8, 11, and 13.

5. The bit according to claim 3, wherein a fourth interior row from gage has a cutting element count of 18; and a fifth interior row from gage has a cutting element count of 16.

6. The bit according to claim 3, further comprising a sixth, a seventh, and an eighth interior row of cutting elements from gage when viewed in rotated profile, and each of the sixth, seventh, and eighth interior rows of cutting elements have a cutting element count selected from the group of 6, 8, 11, 13, 16 and 18.

7. The bit according to claim 6, wherein the sixth interior row has a cutting element count of 13, the seventh interior row has a cutting element count of 11, and the eighth interior row has a cutting element count of 8.

8. The bit according to claim 6, further comprising a ninth, a tenth, an eleventh, a twelfth, and a thirteenth interior row of cutting elements from gage when viewed in rotated profile, and each of the ninth, the tenth, the eleventh, the twelfth, and the thirteenth interior rows of cutting elements have a cutting element count selected from the group of 1, 2, 3, 4, 6 and 8.

9. The bit according to claim 8, wherein the ninth interior row has a cutting element count of 6, the tenth interior row has a cutting element count of 4, the eleventh interior row has a cutting element count of 3, the twelfth interior row has a cutting element count of 1, and the thirteenth interior row has a cutting element count of 1.

10. The bit according to claim 8, further comprising at least one row of ridge cutters positioned on at least one of the cones and arranged staggered with respect to at least one of the interior rows on the at least one cone.

11. The bit according to claim 1, wherein a first interior row adjacent the gage row on at least two of the cones is arranged staggered with respect to the gage row on the at least two of the cones.

12. The bit according to claim 1, wherein the bit has an International Association of Drilling Contractors (IADC) formation classification within the range of 54 to 84.

13. The bit according to claim 1, wherein the bit has an IADC formation classification within the range of 81 to 84.

14. The bit according to claim 1, wherein each of the cones has a cone speed ratio of around 1.4.

15. The bit according to claim 1, wherein the first interior row on at least two of the cones is staggered with respect to the gage row on the at least two of the cones.

16. The bit according to claim 1, wherein the bit has a drive row, and when viewed in rotated profile substantially all of the rows of cutting elements on the bit positioned radially outward from the drive row and radially inward from the gage row with respect to the bit axis have a cutting element count selected from the group of 16, 18, and 21, and substantially all of the rows of cutting elements on the bit positioned radially inward from the drive row with respect to the bit axis have a cutting element count selected from the group of 1, 2, 3, 4, 6, 8, 11, and 13.

17. The bit according to claim 1, wherein when viewed in rotated profile each row has a row rotation ratio comprising a ratio of a distance of a cutting element point of penetration from cone axis to a distance of the cutting element point of penetration to the bit axis, and substantially all of the rows having a row rotation ratio of around 1.4+/−0.025 each have a cutting element count comprising one selected from the group of 6, 8, 11, 13, 16, 18, and 21.

18. The bit according to claim 1, further comprising an IADC formation classification within the range of 54 to 84.

19. A roller cone drill bit comprising:

a bit body having three legs depending therefrom, each leg having a journal, a roller cone rotatably mounted on each journal, each roller cone having a plurality of cutting elements thereon, the cutting elements arranged in rows on each cone, the rows including at least a gage row, a first row interior from and adjacent to the gage row, a second interior row and a third interior row, wherein the bit has an IADC formation classification within the range of 54 to 84, and the first interior row on each of the cones has a cutting element count selected from the group of 16, 18, and 21 the second interior row on each of the cone has a cutting element count selected from the group of 13, 16, 18, and 21, and the third interior row on each of the cone has a cutting element count selected from the group of 4, 6, 8, 11, and 13.

20. The drill bit according to claim 19, further comprising a fourth interior row of cutting elements from the gage row on each of the cones, wherein the fourth interior row on each of the cones has a cutting element count selected from the group of 1, 2, 3, 4, 6, and 8.

21. The bit according to claim 20, wherein the at least one row of ridge cutters has a ridge cutter count selected from the group of 2, 3, 4, and 6.

22. The bit according to claim 19, wherein the bit has an IADC formation classification within the range of 62 to 84.

23. The bit according to claim 22, wherein the bit has an IADC formation classification within the range of 81 to 84.

24. The bit according to claim 19, wherein a first interior row on at least two of the cones is arranged staggered with respect to the gage row on the at least two of the cones.

25. A roller cone drill bit comprising:

a bit body having a central axis and a plurality of legs depending therefrom, each leg having a journal, a roller cone rotatably mounted on each journal, each roller cone having a plurality of cutting elements thereon, the cutting elements arranged in rows on each of the cones, the rows including at least a gage row and a plurality of interior rows positioned radially interior from the gage row, the rows being arranged on each of the cones such that cutting element profiles when viewed in rotated profile partially overlap with other cutting element profiles, and the interior rows on a first one-third of the cone profile adjacent a gage row in rotated profile each have a cutting element count selected from the group of 16, 18, and 21.

26. The bit according to claim 25, wherein the interior rows on a second one-third of the cone profile adjacent the gage row in rotated profile each have a cutting element count selected from the group of 6, 8, 11, 13, and 16.

27. The bit according to claim 26, wherein the interior rows on a third one-third of the cone profile adjacent the gage row, which is proximal to the nose of the cone each have a cutting element count selected from the group of 1, 2, 3, 4, 6, and 8.

28. The bit according to claim 25, wherein the bit has an IADC formation classification within the range of 54 to 84.

29. The bit according to claim 28, wherein the IADC classification is within the range of 81 to 84.

30. A roller cone drill bit comprising:

a bit body having a central axis and a plurality of legs depending therefrom, each leg having a journal, a roller cone rotatably mounted on each journal, each roller cone having a plurality of cutting elements thereon, the cutting elements arranged in rows on each of the cones, the rows including at least a gage row and a plurality of interior rows positioned radially interior from the gage row, the rows being arranged on each of the cones such that cutting element profiles when viewed profile partially overlap with other cutting element profiles, and wherein at least one of the cutting elements on each of the cones comprises a reference point P at ⅓ of its extension height from the insert tip along the insert axis which lies within a geometric envelope defined between 50% and 90% of the distance from the bit centerline to a gage diameter of the bit and between boundaries corresponding to a bit to cone radius ratios of 1.350 and 1.475.

* * * * *